US010131155B2

(12) United States Patent
Jackson et al.

(10) Patent No.: US 10,131,155 B2
(45) Date of Patent: Nov. 20, 2018

(54) INKJET PRINTHEAD WITH BUTTING PRINTHEAD CHIPS ATTACHED TO COMMON SUPPORT WEB

(71) Applicant: Memjet Technology Ltd., Dublin (IE)

(72) Inventors: Garry Jackson, North Ryde (AU); Norman Berry, North Ryde (AU); Michael Hudson, North Ryde (AU); Brian Brown, North Ryde (AU); Samuel Mallinson, North Ryde (AU); Geordie McBain, North Ryde (AU)

(73) Assignee: Memjet Technology Ltd. (IE)

( * ) Notice: Subject to any disclaimer, the term of this patent is extended or adjusted under 35 U.S.C. 154(b) by 0 days.

(21) Appl. No.: 15/583,185

(22) Filed: May 1, 2017

(65) Prior Publication Data

US 2017/0313069 A1 Nov. 2, 2017

Related U.S. Application Data

(60) Provisional application No. 62/377,467, filed on Aug. 19, 2016, provisional application No. 62/330,776, filed on May 2, 2016.

(51) Int. Cl.

| | |
|---|---|
| ***B41J 2/14*** | (2006.01) |
| ***B41J 2/19*** | (2006.01) |
| ***B41J 2/155*** | (2006.01) |
| ***B41J 2/175*** | (2006.01) |

(Continued)

(52) U.S. Cl.

CPC ..... *B41J 2/19* (2013.01); *B41J 2/045* (2013.01); *B41J 2/1433* (2013.01); *B41J 2/14145* (2013.01); *B41J 2/155* (2013.01); *B41J 2/17553* (2013.01); *B41J 2/515* (2013.01); *B41J 2002/14362* (2013.01);

(Continued)

(58) Field of Classification Search

CPC ..... B41J 2/14145; B41J 2002/14419; B41J 2202/21; B41J 2/045; B41J 2/155; B41J 2/19; B41J 2/515

See application file for complete search history.

(56) References Cited

U.S. PATENT DOCUMENTS 6,692,113 B2 * 2/2004 Silverbrook ..... B41J 2/14 347/63
7,347,534 B2 * 3/2008 Silverbrook ..... B41J 2/04541 347/54

(Continued)

FOREIGN PATENT DOCUMENTS

WO 02/076753 A1 10/2002

OTHER PUBLICATIONS

ISR and Written Opinion No. PCT/EP2017/058713 dated Jul. 14, 2017.

*Primary Examiner* — Huan Tran
(74) *Attorney, Agent, or Firm* — Cooley LLP

(57) ABSTRACT

An inkjet printhead including: an elongate fluid manifold having a plurality of fluid outlets positioned longitudinally along a base of the fluid manifold, each neighboring pair of fluid outlets being separated by a support web; and a plurality of butting printhead chips arranged in a row and attached to the base of the fluid manifold, each printhead chip receiving a printing fluid from one or more fluid outlets. Each butting pair of printhead chips has respective butting end portions commonly supported by one of the support webs.

9 Claims, 14 Drawing Sheets

(51) Int. Cl.
*B41J 2/045* (2006.01)
*B41J 2/515* (2006.01)

(52) U.S. Cl.
CPC .. *B41J 2002/14419* (2013.01); *B41J 2202/20* (2013.01); *B41J 2202/21* (2013.01)

(56) References Cited

U.S. PATENT DOCUMENTS

| | | | | |
|---|---|---|---|---|
| 8,025,383 | B2 * | 9/2011 | Brown | B41J 2/14 347/54 |
| 8,596,769 | B2 * | 12/2013 | Hibbard | B41J 2/1752 347/42 |
| 9,150,034 | B2 * | 10/2015 | Love | B41J 2/16585 |
| 2007/0206070 | A1 | 9/2007 | Morgan | |
| 2009/0231384 | A1 | 9/2009 | Keshishian | |
| 2011/0277303 | A1 * | 11/2011 | Mallory | B41J 2/175 29/447 |
| 2015/0165767 | A1 * | 6/2015 | Owaki | B41J 2/14233 347/54 |
| 2017/0313072 | A1 * | 11/2017 | Jackson | B41J 2/1433 |
| 2017/0313092 | A1 * | 11/2017 | Jackson | B41J 2/1433 |
| 2017/0313098 | A1 * | 11/2017 | Jackson | B41J 2/1433 |

* cited by examiner

INKJET PRINTHEAD WITH BUTTING PRINTHEAD CHIPS ATTACHED TO COMMON SUPPORT WEB

CROSS-REFERENCE TO RELATED APPLICATIONS

The present application claims the benefit of priority under 35 U.S.C. § 119(e) of U.S. Provisional Application No. 62/330,776, entitled MONOCHROME INKJET PRINTHEAD CONFIGURED FOR HIGH-SPEED PRINTING, filed May 2, 2016 and of U.S. Provisional Application No. 62/377,467, entitled MONOCHROME INKJET PRINTHEAD CONFIGURED FOR HIGH-SPEED PRINTING, filed Aug. 19, 2016, the contents of each of which are hereby incorporated by reference in their entirety for all purposes.

The present application is related to U.S. application Ser. No. 15/582,998, entitled PRINTER HAVING PRINTHEAD EXTENDING AND RETRACTING THROUGH MAINTENANCE MODULE, filed on even date herewith, to U.S. application Ser. No. 15/582,979, entitled INK DELIVERY SYSTEM FOR SUPPLYING INK TO MULTIPLE PRINTHEADS AT CONSTANT PRESSURE, filed on even date herewith, and to U.S. application Ser. No. 15/582,985, entitled INK DELIVERY SYSTEM WITH ROBUST COMPLIANCE, filed on even date herewith, the contents of each of which are hereby incorporated by reference in their entirety for all purposes.

FIELD OF THE INVENTION

This invention relates to an inkjet printhead. It has been developed primarily to enable monochrome high-speed printing with management of high ink flow rates, hydrostatic pressure surges and bubble venting.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

Multi-color Memjet® printhead cartridges are generally based on the liquid crystal polymer (LCP) manifold described in U.S. Pat. No. 7,347,534, the contents of which are incorporated herein by reference. A plurality of butted Memjet chips are bonded to a surface of the LCP manifold via an apertured die-attach film. The LCP manifold cooperates with the die-attach film to direct ink from each of five main ink channels to respective color planes of each Memjet® chip via a series of tortuous ink paths.

As described in U.S. Pat. No. 8,025,383, the contents of which are incorporated herein by reference, the LCP manifold additionally incorporates a series of air boxes positioned above the five main ink channels for dampening hydrostatic pressure fluctuations.

Memjet® printhead cartridges, comprising the LCP manifold described above, provide a versatile platform for the construction of a wide range of single-pass inkjet printers, including office, label, wideformat and industrial printers. Industrial printers typically have a plurality of printheads aligned in a media feed direction, as described in U.S. Pat. No. 8,845,080, the contents of which are incorporated herein by reference.

Although the Memjet® printhead cartridge is designed for multi-color printing, some types of printer require monochrome printing only. For example, the industrial printers described in U.S. Pat. No. 8,845,080 employ five monochrome printhead cartridges in order to maximize print speeds. Trivially, the LCP manifold can be plumbed with one color of ink to provide monochrome printing from the nominally five-color Memjet® printhead chips. However, at very high print speeds, the LCP manifold has some practical limitations. The multiple labyrinthine ink pathways from the LCP manifold to the printhead chips may be responsible for unexpected de-priming when the printhead is running at high speeds. Without a sufficient body of ink close to the printhead chips, the chips may become starved of ink under periods of high ink demand and lead to chip de-priming. Secondly, the labyrinthine ink pathways are susceptible to trapping air bubbles; if an air bubble become trapped in the system, the printhead chips will become starved of ink and de-prime. Thirdly, the air boxes provide a relatively stiff compliance in the hydrostatic system; if a particular group of nozzles demands higher ink flow, then the resistance of the air boxes may be too great to allow the hydrostatic system to respond dynamically to the increased demand.

It would therefore be desirable to provide a printhead assembly configured for high-speed monochrome printing, which addresses at least some of the shortcomings of the LCP manifold described above.

SUMMARY OF THE INVENTION

In a first aspect, there is provided an inkjet printhead comprising:

an elongate fluid manifold having a base comprising a truss structure, the truss structure having webs extending between opposite chords, wherein a plurality of openings between the webs and the chords define fluid outlets; and one or more printhead chips attached to the webs of the truss structure, each printhead chip receiving printing fluid from a plurality of the fluid outlets.

The inkjet printhead according to the sixth aspect provides a highly stable structure for printhead chip attachment whilst still providing an open fluidic architecture allowing high ink flow rates and bubble venting pathways.

Preferably, a plurality of the webs are contiguously defined by a wavelike structure extending along a gap defined between the chords.

Preferably, the fluid outlet are generally triangular or bell-shaped.

Preferably, a plurality of butting printhead chips are arranged in a row along the truss structure.

Preferably, the truss structure includes a joint web at chip join regions, wherein each butting pair of printhead chips have respective butting end portions commonly supported by one of the joint webs.

Preferably, the printhead chips are attached to the base via an adhesive film.

Preferably, the printhead chips have a width of less than the distance between the opposite chords, and wherein the adhesive film seals a gap between the edges printhead chips and the chords.

Preferably, the fluid manifold is comprised of a molded polymer material.

Preferably, each fluid outlet is laterally flared from one side of a respective printhead chip towards an opposite side of the printhead chip.

Preferably, a wider end of each fluid outlet extends beyond a longitudinal edge of a respective printhead chip.

Preferably, each fluid outlet is flared towards a respective bubble-venting cavity.

Preferably, each bubble-venting cavity is positioned beyond a longitudinal edge of a respective printhead chip.

Preferably, each bubble-venting cavity has a floor defined by a shelf stepped from a respective fluid outlet.

Preferably, the floor is curved downwards towards the respective fluid outlet.

In a second aspect, there is provided an inkjet printhead comprising:

an elongate fluid manifold comprising at least one longitudinally extending channel, the fluid manifold having a base defining a plurality of fluid outlets, the fluid outlets being positioned longitudinally along a floor of the channel;

a plurality of printhead chips attached to the base of the fluid manifold, each printhead chip receiving printing fluid from one or more fluid outlets; and an elongate flexible film extending longitudinally along a roof of the channel, the flexible film being positioned opposite the plurality of fluid outlets.

The printhead according to the second aspect advantageously dampens hydrostatic pressure spikes in the ink whilst maximizing ink flow rates to the printhead chips.

Preferably, the ink manifold comprises an upper part and a lower part, the upper and lower parts cooperating to define the channel.

Preferably, the upper part comprises the flexible film.

Preferably, the lower part comprises the plurality of ink supply outlets.

Preferably, the roof of the ink manifold defines an elongate opening, the flexible film sealing the elongate opening.

In a third aspect, there is provided an inkjet printhead comprising:

an elongate fluid manifold having a plurality of fluid outlets positioned longitudinally along a base of the fluid manifold, each neighboring pair of fluid outlets being separated by a support web;

a plurality of butting printhead chips arranged in a row and attached to the base of the fluid manifold, each printhead chip receiving a printing fluid from one or more fluid outlets, wherein each butting pair of printhead chips have respective butting end portions commonly supported by one of the support webs.

The printhead according to the third aspect advantageously provides a mounting arrangement for butting printhead chips, which minimizes occlusion of ink supply channels defined in the backsides of the printhead chips.

Preferably, each ink supply slot is relatively longer than each support web along a longitudinal axis of the ink manifold.

Preferably, each support web occludes less than 10%, less than 8%, or less than 5% of an area of ink supply channels defined in a backside of each printhead chip.

Preferably, each of the support webs supporting the butting end portions has a profile corresponding to the ends of the printhead chips.

Preferably, each of the support webs supporting the butting end portions extends diagonally between fluid outlets at either side thereof.

Preferably, each printhead chip has a mid-portion between opposite end portions, the mid-portion being supported by one or more of the support webs.

Preferably, a number of support webs supporting the mid-portion of each printhead chip is five or less.

Preferably, each fluid outlet has a width of at least half a width of each printhead chip.

Preferably, a combined area of fluid outlets supplying printing fluid to one printhead chip is at least half a total area of the printhead chip.

Preferably, the printhead chips are attached to the base of the ink manifold via an adhesive film, the adhesive film having openings aligned with the fluid outlets.

In a fourth aspect, there is provided an inkjet printhead comprising:

an elongate fluid manifold having a base defining a plurality of fluid outlets; and a plurality of printhead chips attached to the base of the fluid manifold, each printhead chip receiving ink from one or more fluid outlets, wherein each fluid outlet extends transversely across the ink manfold and extends at least half a width of each printhead chip.

Preferably, a combined area of fluid outlets supplying ink to one printhead chip is at least half a total area of the printhead chip.

The printhead according to the fourth aspect advantageously maximizes a volume of ink available to each printhead chip, providing high diffusion rates and reducing the propensity for inkjet nozzles to become clogged with ink.

In a fifth aspect, there is provided an inkjet printhead comprising:

an elongate fluid manifold comprising at least one longitudinally extending channel, the fluid manifold having a base defining a plurality of ink outlets, the fluid outlets being spaced apart longitudinally along a floor of the channel;

a plurality of printhead chips bonded to the base of the fluid manifold, each printhead chip receiving ink from one or more fluid outlets; and a plurality of transverse ribs positioned across the channel, each transverse rib extending upwardly from the floor of the channel, wherein one or more of the transverse ribs has a recess allowing fluid flow along the floor of the channel between the transverse ribs.

The printhead according to the fifth aspect advantageously enables any trapped bubbles to be flushed from the fluid manifold whilst maximizing the structural rigidity of the fluid manifold.

Preferably, the fluid manifold comprises an upper part and a lower part, the upper and lower parts cooperating to define the channel.

Preferably, the lower part comprises the transverse ribs and the plurality of fluid outlets.

Preferably, the upper part comprises further transverse ribs extending across the channel.

In a sixth aspect there is provided an inkjet printhead comprising:

an elongate fluid manifold having a plurality of fluid outlets positioned longitudinally along a base of the fluid manifold;

one or more printhead chips attached to the base of the fluid manifold, each printhead chip receiving printing fluid from one or more fluid outlets, wherein each fluid outlet is laterally flared towards a longitudinal edge of a respective printhead chip.

The printhead according to the sixth aspect advantageously facilitates movement of air bubbles laterally away from a footprint of the printhead chips.

Preferably, the fluid outlets are alternately laterally flared towards opposite longitudinal edges of the printhead chips.

Preferably, a plurality of butting printhead chips are arranged in a row along the base of the fluid manifold.

Preferably, each fluid outlet has a generally triangular or bell-shaped opening facing a respective printhead chip.

Preferably, each fluid outlet is laterally flared from one side of a respective printhead chip towards an opposite side of the printhead chip.

Preferably, the printhead chips are attached to the fluid manifold via an adhesive film, the film having openings aligned with the fluid outlets.

Preferably, a wider end of each fluid outlet extends beyond a longitudinal edge of a respective printhead chip.

Preferably, each fluid outlet is flared towards a respective bubble-venting cavity.

Preferably, each bubble-venting cavity is positioned beyond a longitudinal edge of a respective printhead chip.

Preferably, each bubble-venting cavity has a floor defined by a shelf stepped from a respective fluid outlet.

Preferably, the floor is curved downwards towards the respective fluid outlet.

In a seventh aspect there is provided an inkjet printhead comprising:

an elongate fluid manifold having a base comprising a plurality of fluid delivery compartments, each compartment having a fluid outlet and a bubble-venting cavity; and one or more printhead chips attached to the base, each printhead chip receiving printing fluid from one or more fluid outlets, wherein each fluid outlet is aligned with a respective printhead chip and each bubble-venting cavity is offset from the respective printhead chip.

The inkjet printhead according to the seventh aspect advantageously facilitates bubble venting such that vented bubbles do not stagnate in fluid outlets and block ink flow pathways to printhead chips.

Preferably, each fluid outlet is configured for moving bubbles towards the bubble-venting cavity.

Preferably, each fluid outlet is flared towards the bubble-venting cavity.

Preferably, each fluid delivery compartment comprises a shelf defining a floor for the bubble-venting cavity.

Preferably, the shelf has an edge curved towards the fluid outlet.

Preferably, one or more fluid supply channels of the printhead chip are aligned with each fluid outlet.

Preferably, the fluid outlets are alternately flared towards opposite longitudinal edges of the printhead chips.

In an eighth aspect there is provided an inkjet printhead comprising:

an elongate fluid manifold comprising: an inlet boss, an outlet boss, a longitudinal channel extending between the inlet and outlet bosses, a plurality of air cavities positioned above the longitudinal channel in a roof cavity of the fluid manifold, and plurality of fluid outlets defined in a floor of the longitudinal channel; and a plurality of printhead chips attached to the base of the fluid manifold, each printhead chip receiving printing fluid from one or more fluid outlets; and wherein:

the air cavities are defined by ribs extending from a roof of the fluid manifold towards the longitudinal channel; and each rib has a lip protruding beyond a lower surface of the inlet and outlet bosses.

The inkjet printhead according to the eighth aspect advantageously provides self-regulating air cavities, whereby ink flow between inlet and outlet bosses of the fluid manifold is used to shear off any air bubbles protruding from the air cavities.

Preferably, the fluid manifold comprises an upper part and a lower part, the upper and lower parts cooperating to define the channel.

Preferably, the upper part comprises the inlet boss, the outlet boss and the air cavities.

Preferably, the lower part comprises the base.

Preferably, the upper and lower parts each have walls cooperating to define sidewalls of the channel.

In a ninth aspect, there is provided an inkjet printhead comprising:

an elongate fluid manifold comprising at least one longitudinally extending channel, the fluid manifold having a base defining a plurality of fluid outlets, the fluid outlets being spaced apart along a floor of the channel;

a plurality of printhead chips bonded to the base of the fluid manifold, each printhead chip receiving ink from one or more fluid outlets; and a plurality of transverse ribs positioned across the channel, each transverse rib extending upwardly from the floor of the channel.

Preferably, one or more transverse ribs positioned towards longitudinal ends of the channel have a lower height than transverse ribs positioned at a middle portion of the channel.

Preferably, a height of the transverse ribs is tapered towards the longitudinal ends of the channel.

Preferably, one of more of the transverse ribs has an inverted arch profile.

Preferably, the transverse ribs positioned towards the longitudinal ends of the channel have an inverted arch profile.

Preferably, one longitudinal end of the channel is an inlet end and an opposite longitudinal end of the channel is an outlet end.

Preferably, an ink flow direction changes perpendicularly at the inlet and outlet ends.

Preferably, the fluid manifold comprises an upper part and a lower part, the upper and lower parts cooperating to define the channel.

Preferably, the lower part comprises the transverse ribs and the plurality of fluid outlets.

Preferably, the upper part comprises inlet and outlet bosses meeting with respective inlet and outlet ends of the channel.

Preferably, the upper part comprises further transverse ribs extending across a roof of the channel.

Preferably, the transverse ribs of the lower part and the further transverse ribs of the upper part are offset from each other.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, fixatives (e.g. pre-coats and finishers), 3D printing fluids and the like.

As used herein, the term "mounted" includes both direct mounting and indirect mounting via an intervening part.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
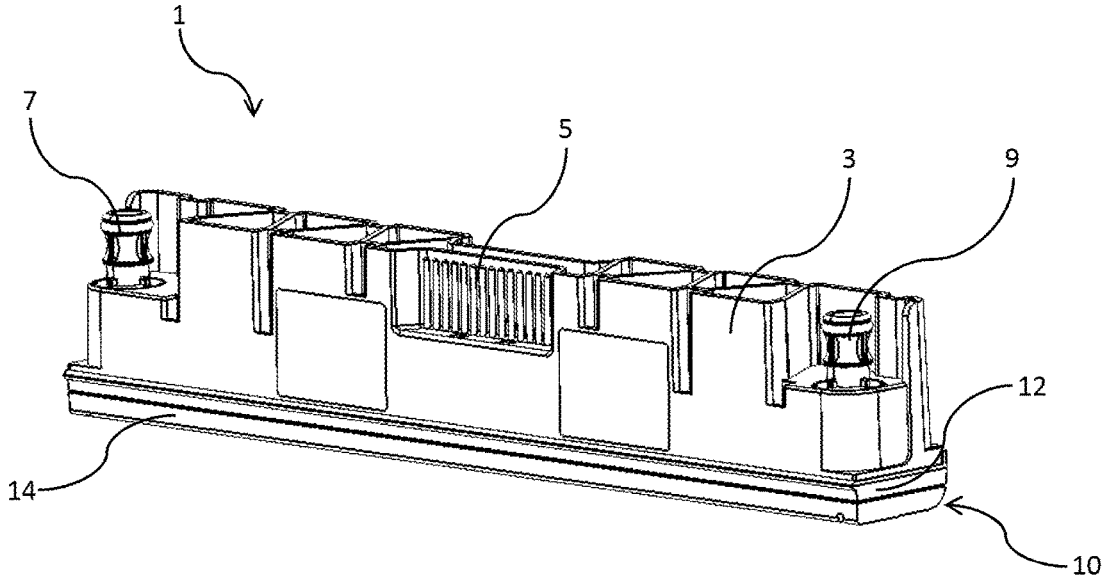
FIG. 1 is a front perspective view of an inkjet printhead assembly according to the invention.

Referring to FIG. 1, there is shown an inkjet printhead 1 in the form of a replaceable printhead cartridge for user insertion in a printer (not shown). The printhead 1 comprises an elongate body 3 having a central gripping portion 5 for facilitating user removal and insertion. A first coupling 7 is positioned towards one longitudinal end of the elongate body 3 and a second fluid coupling 9 is positioned towards an opposite longitudinal end of the elongate body. The first and second fluid couplings 7 and 9 are configured for coupling with complementary fluid couplings (not shown) of, for example, an ink delivery module supplying ink to and from the printhead 1. The fluid couplings extend generally upwards in a direction perpendicular to a nozzle plate of the printhead 1 in order to minimize an overall footprint of the printhead and allow close packing of multiple printheads along a media feed path.

The body 3 provides stiffness and support for an ink manifold assembly 10 attached to the body via a snap-fitting engagement. The ink manifold assembly 10 comprises an upper ink manifold 12 and a lower ink manifold 14, which are in fluid communication with the fluid couplings 7 and 9 of the body 3. The upper and lower ink manifolds 12 and 14 are typically comprised of a rigid, stiff material, such as a liquid crystal polymer (LCP) although other rigid materials (e.g. glass, ceramic etc) are of course within the ambit of the present invention.

Figure 2:
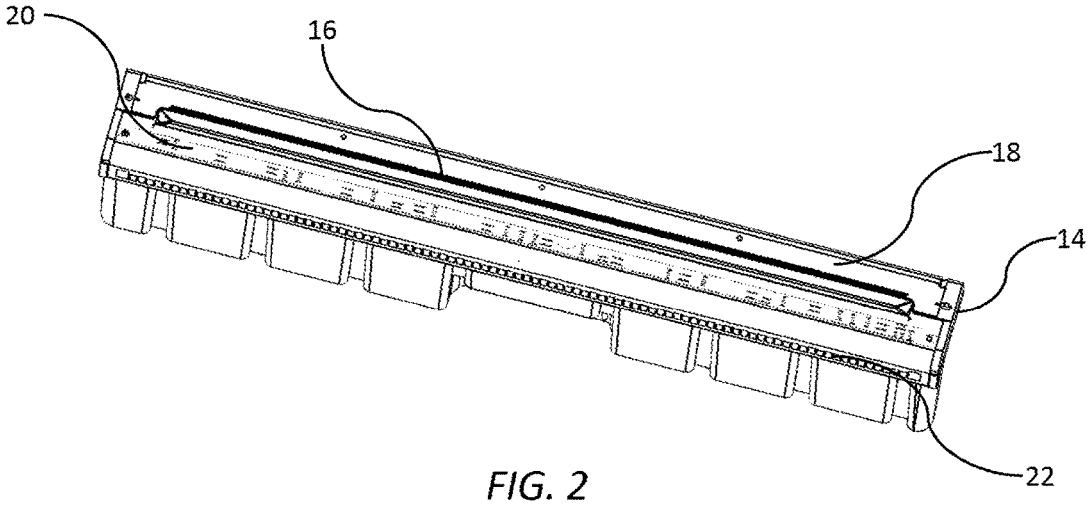
FIG. 2 is a bottom perspective of the printhead assembly.

Turning to FIG. 2, an array of printhead integrated circuits ("chips") 16 are butted end-to-end in a line and attached to an underside of the lower ink manifold 14 via a die-attach film 18. The die-attach film 18 may comprise a double-sided adhesive film with suitable laser-drilled openings for delivering ink, as described in, for example, U.S. Pat. No. 7,736,458 and US U.S. Pat. No. 7,845,755, the contents of which are incorporated herein by reference. The printhead chips 16 receive power and data signals from a flex PCB 20 wrapped around the ink manifold 10, the flex PCB in turn receiving power and data signals from a printer controller (not shown) via a series of electrical contacts 22 extending longitudinally extending along the printhead 1. Each printhead chip 16 receives data and power from the flex PCB 20 via wire bonds, which are protected with an encapsulant material extending along one longitudinal edge region of each printhead chip. Suitable wirebonding arrangements will be well known to the person skilled in the art and are described, in for example, U.S. Pat. No. 8,025,204, the contents of which are incorporated herein by reference.

Figure 3:
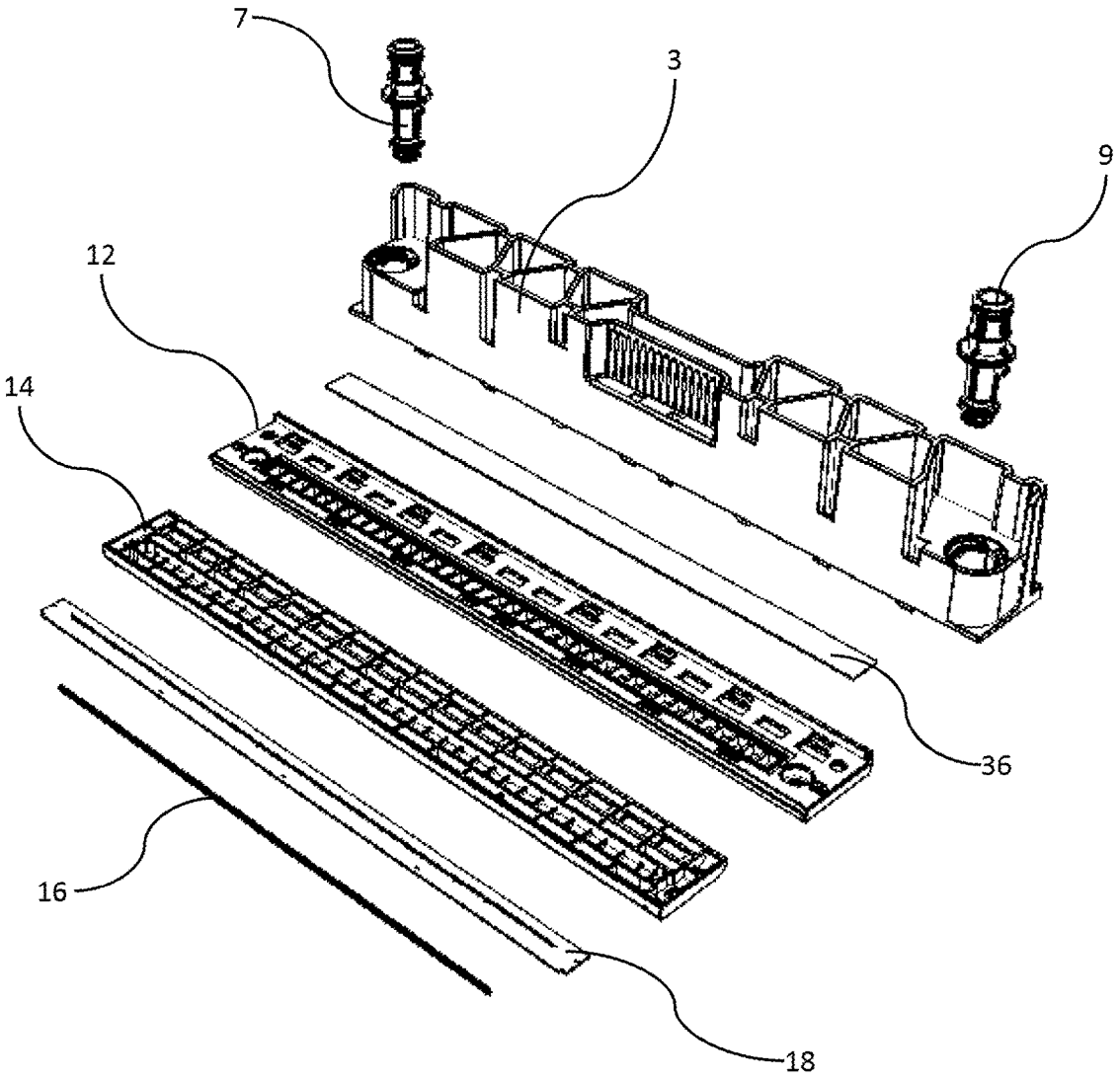
FIG. 3 is an exploded perspective of the printhead assembly.
Figure 4:
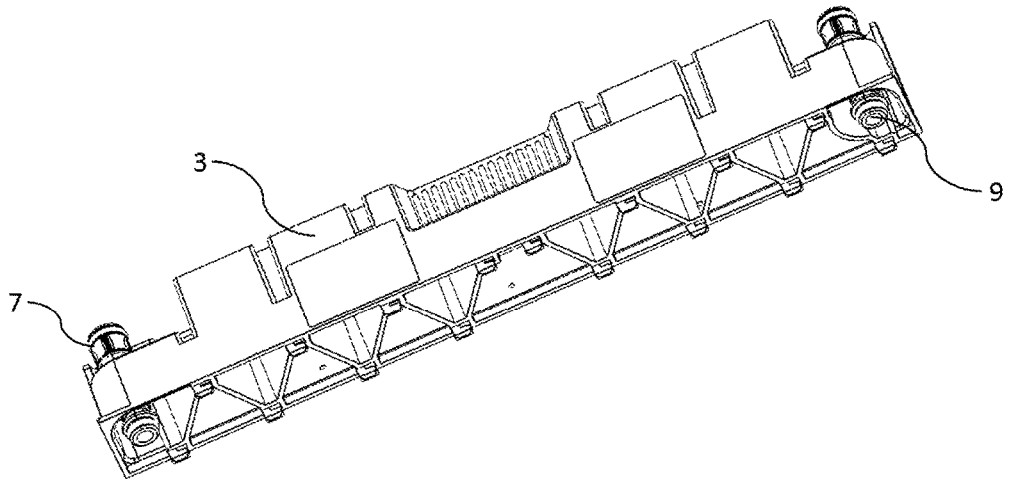
FIG. 4 is a bottom perspective of a body portion of the printhead assembly.

FIG. 3 shows the main components of the printhead 1 in an exploded perspective with the flex PCB 20 removed for clarity. The upper and lower ink manifolds 12 and 14 are sealingly bonded to each other to define the ink manifold assembly 10, while the upper ink manifold is secured to the body 3 via complementary snap-lock features. Details of the upper and lower ink manifolds 12 and 14, as well as alternative embodiments thereof, will now be described with reference to the remaining figures.

The upper ink manifold 12 and lower ink manifold 14 are bonded together and cooperate to define a main ink channel 25 extending longitudinally along the ink manifold assembly 10. Ink is received in the main ink channel 25 from the first fluid coupling 7 via an inlet 27 defined at one end of the upper ink manifold 12; and ink exits the second fluid coupling 9 via an outlet 29 defined in the upper ink manifold 12 at an opposite longitudinal end of the main ink channel 25.

Figure 7:
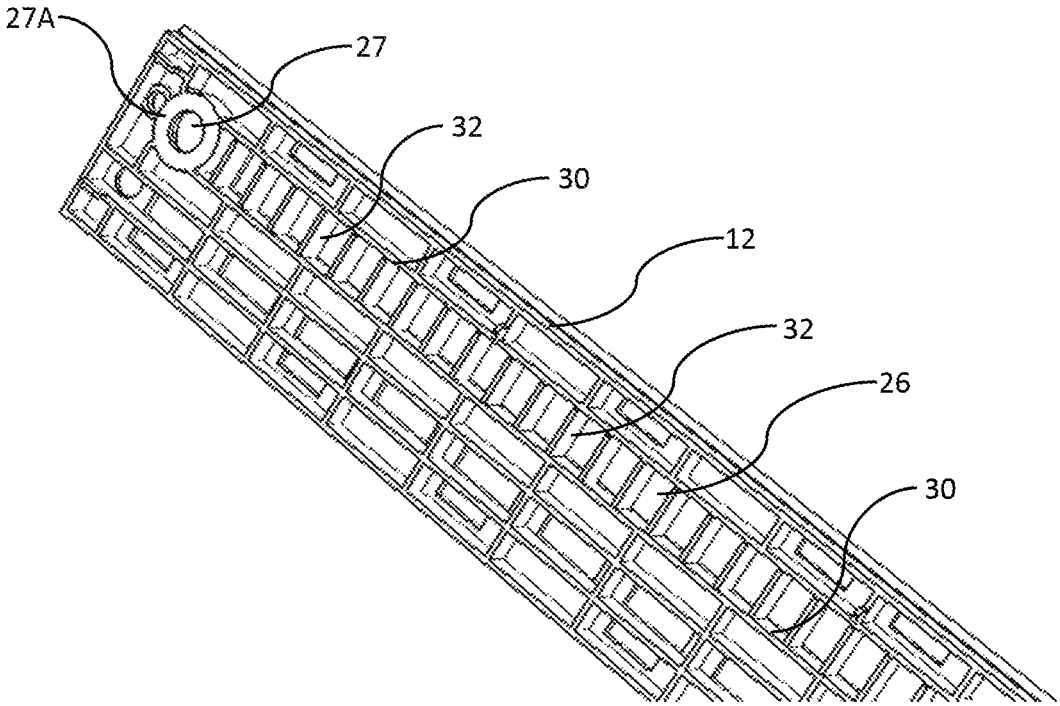
FIG. 7 is a bottom perspective of the upper ink manifold.
Figure 8:
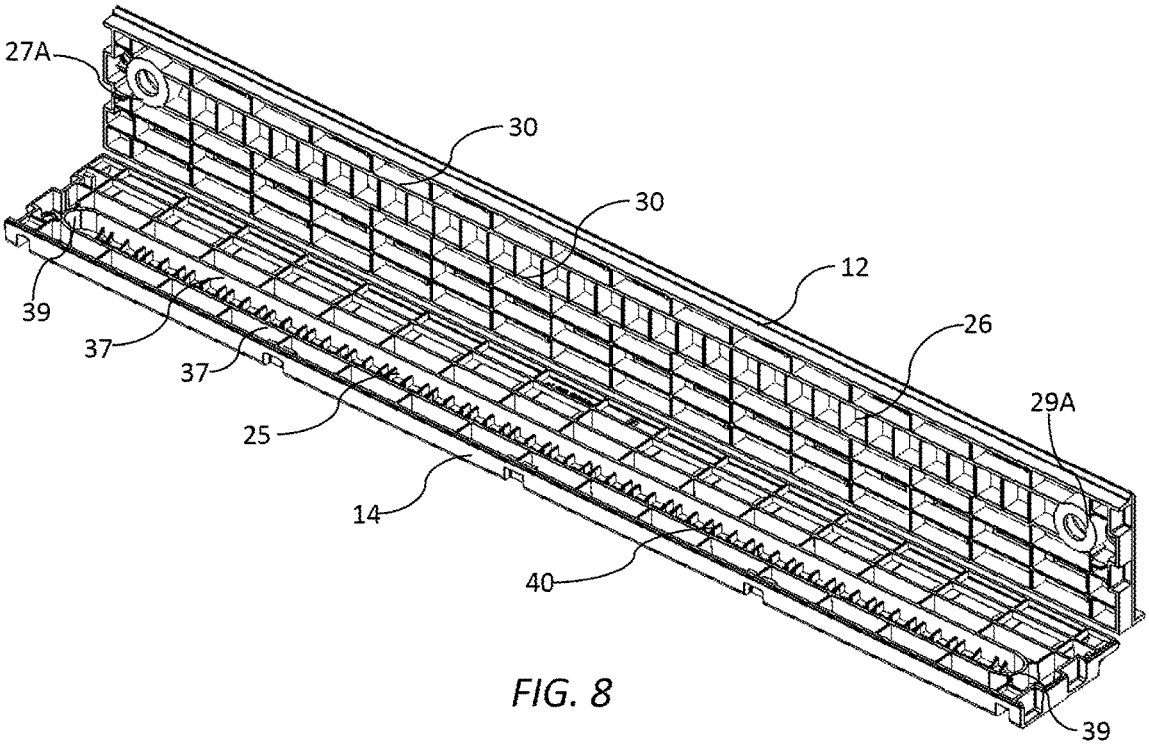
FIG. 8 is a perspective of the upper and lower ink manifolds.

As best shown in FIGS. 7 and 8, the upper ink manifold 12 comprises a pair of opposed longitudinal sidewalls 30 extending between an inlet boss 27A and an outlet boss 29A of the respective inlet 27 and outlet 29. The inlet boss 27A and outlet boss 29A define lower surfaces which are coplanar with lower surfaces of the sidewalls 30. A series of first ribs 32 extend transversely within a roof cavity of the upper ink manifold 12 and between the longitudinal sidewalls 30. The first ribs 32 extend generally downwards from the roof of the upper ink manifold 12 towards the main ink channel 25. Hence, the first ribs 32 positioned in the roof cavity of the upper ink manifold 12 define a number of individual cavities 26, which, in use, are filled with air.

Figure 5:
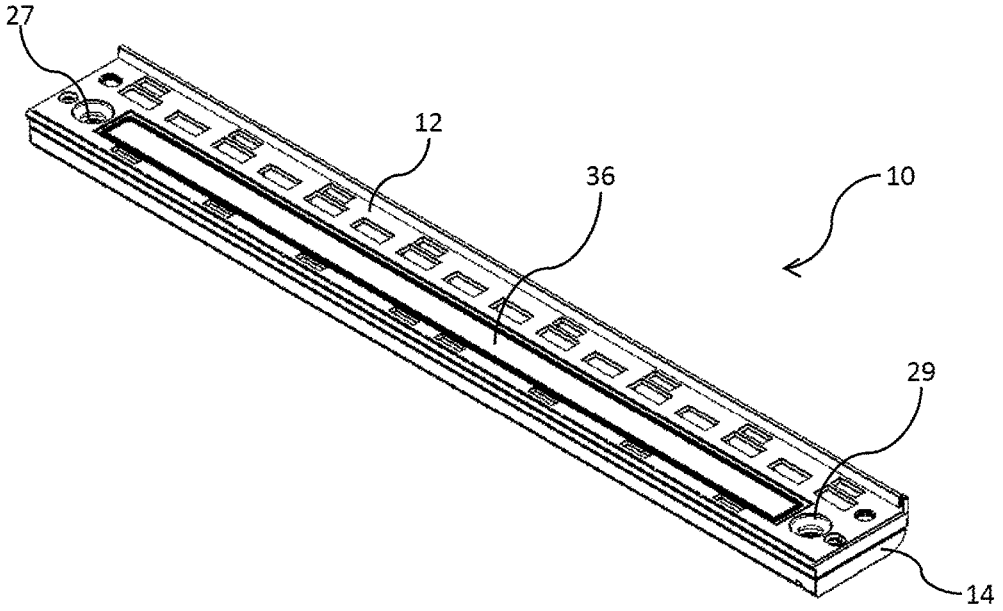
FIG. 5 is a top perspective an ink manifold assembly.
Figure 6:
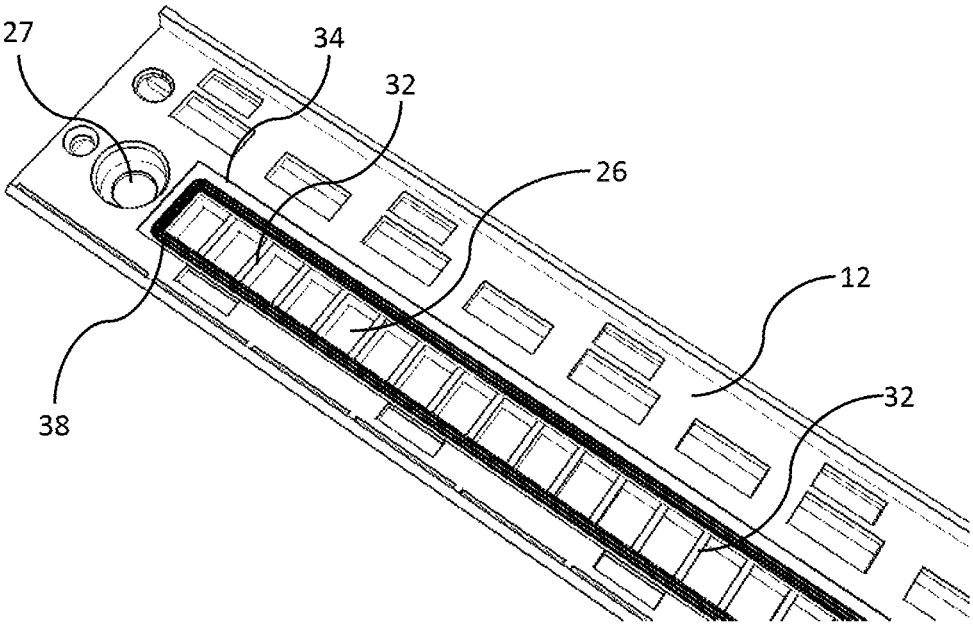
FIG. 6 is a top perspective of an upper ink manifold.

Referring to FIGS. 5 and 6, the roof of the upper ink manifold 12 defines a perimeter lip 34 having an elongate flexible film 36 (e.g. polymer film) bonded thereto so as to cover and seal the air cavities 26. A compliant perimeter seal 38 is positioned around the perimeter lip 34 to ensure effective sealing of the air cavities 26 by the flexible film 36. A rigid cover (not shown) may be positioned over the flexible film 36 so as to protect it from damage and minimize evaporation through the film.

The flexible film 36 in combination with the air cavities 26 serves to dampen hydrostatic pressure fluctuations in a manner similar to the air boxes described in U.S. Pat. No. 8,025,383, the contents of which are incorporated herein by reference. For example, when printing suddenly ceases, the flexible film 36 is able to absorb a pressure spike in the ink line and minimize any printhead face flooding as a result. However, the flexible film 36 provides a greater degree of compliance than air boxes alone; therefore, the printhead 1 provides highly effective dampening, especially for high-speed printing. Furthermore, the flexible film 36 is suitable for responding rapidly and dynamically to the high flow rate demands of high-speed printing, because the film can simply flex towards the printhead chips 16 when required. Of course, in some embodiments, the film 36 may be absent and the air cavities 26 may dampen pressure fluctuations with a roof structure similar to the arrangement described in U.S. Pat. No. 8,025,383. In other embodiments, the air cavities may be absent and the film 36 is solely responsible for dampening pressure fluctuations in the printhead 1.

As best shown in FIG. 8, the lower ink manifold 14 has an upper surface configured for complementary engagement with a lower surface of the upper ink manifold 12. In particular, an elongate perimeter sidewall 37 is positioned to meet with the longitudinal sidewalls 30 of the upper ink manifold 12 to define the main ink channel 25. The perimeter sidewall 37 has curved endwalls 39 at each longitudinal end, which seal against the inlet and outlet bosses 27A and 29A, respectively, of the upper ink manifold 12. A plurality of second ribs 40 extend transversely between the opposed longitudinal sections of the perimeter sidewall 37. The second ribs 40 provide structural rigidity to the lower ink manifold 14 whilst maximizing the volume of the main ink channel 25. The first ribs 32 and second ribs 40 have surfaces spaced from each other so as to allow ink flow through the main channel 25. The first ribs 32 and second ribs 40 are offset from each other to avoid any pinch points in the ink flow path through the main ink channel 25.

Figure 9:
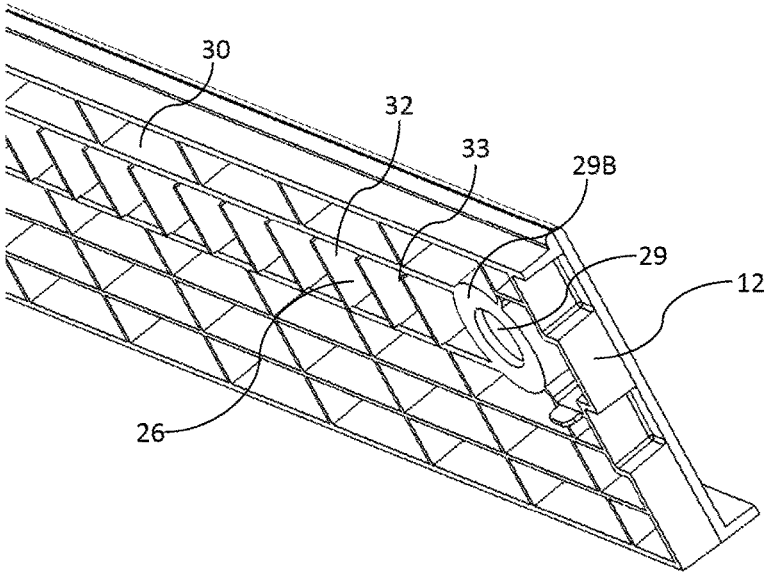
FIG. 9 is a magnified view of the upper ink manifold.
Figure 10:
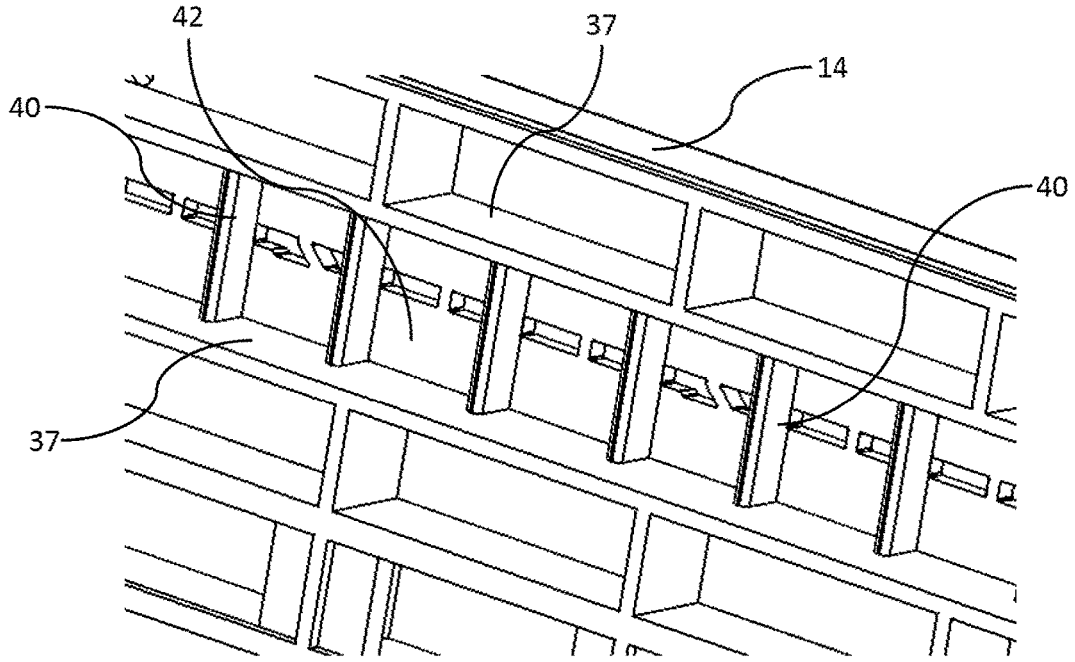
FIG. 10 is a magnified view of the lower ink manifold.
Figure 11:
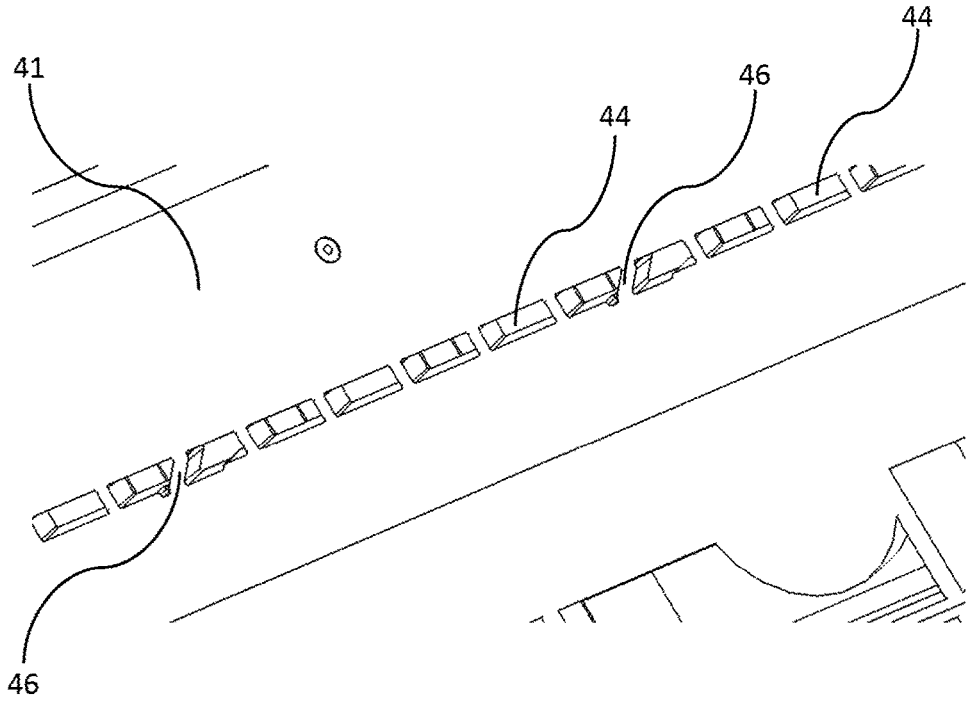
FIG. 11 is a magnified view of ink supply slots in the lower ink manifold.
Figure 12:
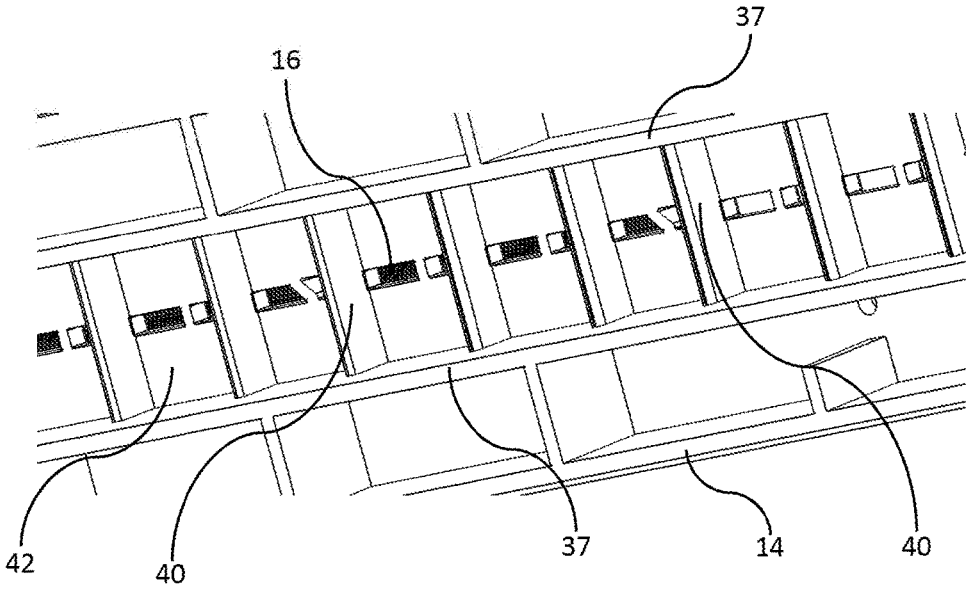
FIG. 12 is a magnified of the lower ink manifold with printhead chips attached.
Figure 13:
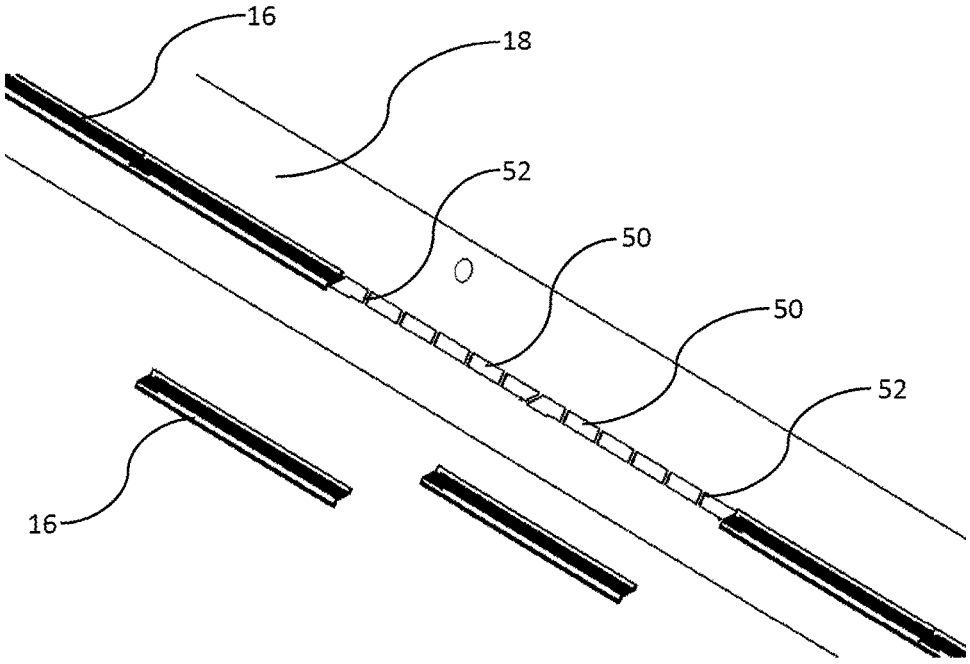
FIG. 13 shows the attachment of printhead chips to a die-attach film.
Figure 14:
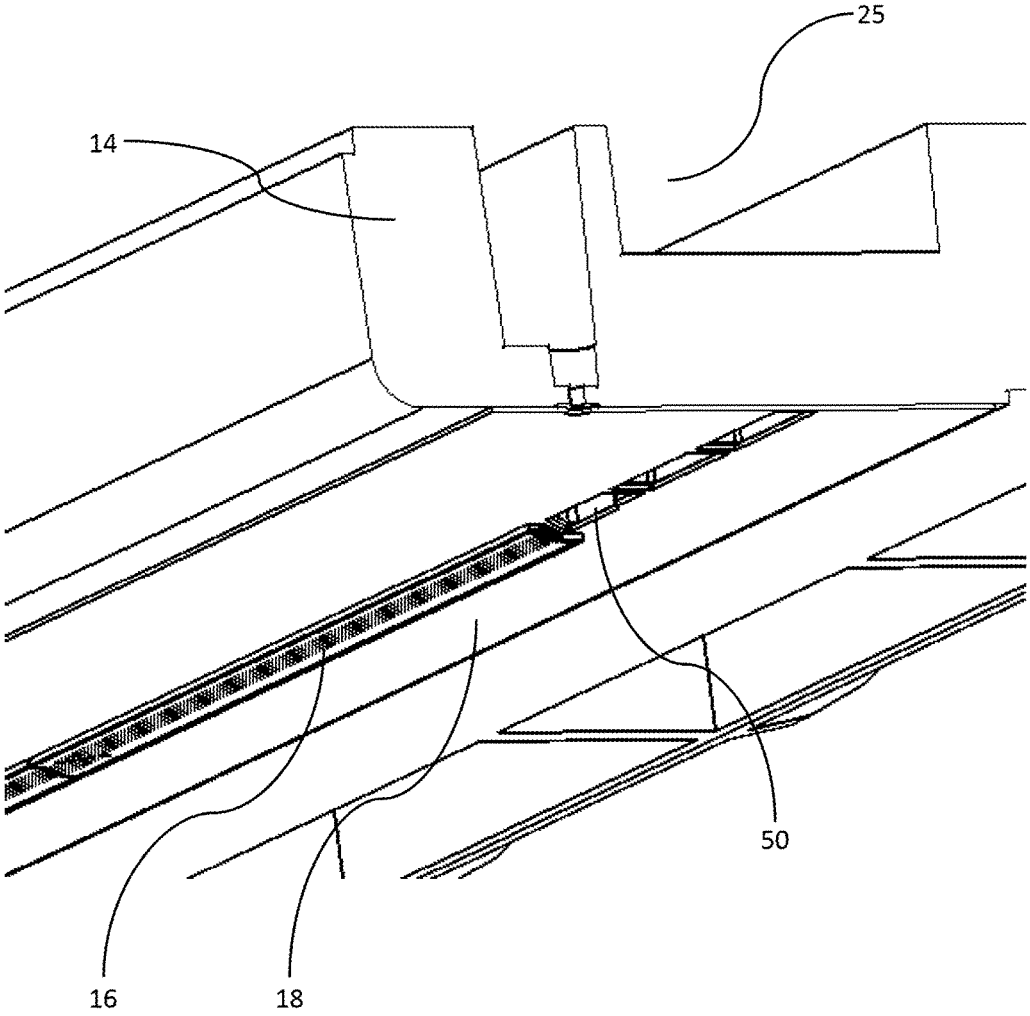
FIG. 14 is a cutaway perspective of the lower ink manifold with printhead chips attached.
Figure 15:
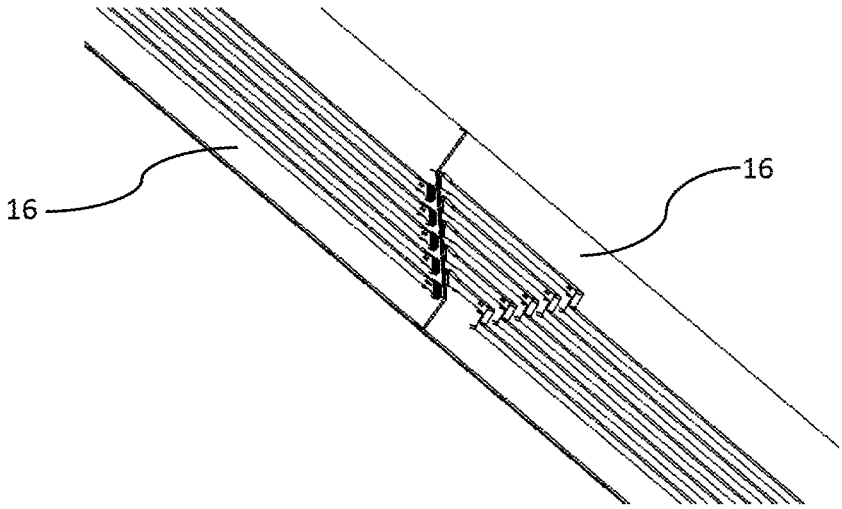
FIG. 15 shows a pair of butted printhead chips.

The inlet boss 27A, outlet boss 29A and the longitudinal sidewalls 30 of the upper ink manifold have coplanar lower surfaces which define the upper extent of the main ink channel 25 when the air cavities 26 are filled with air. As best shown in FIG. 9, each of the first ribs 32 has a lip 33 protruding beyond the coplanar lower surfaces of the inlet boss 27A, outlet boss 29A and longitudinal sidewalls 30. This arrangement optimizes self-regulation of the air cavities 26. Thus, if any of the air cavities 26 becomes overfilled with air, a flow of ink through the main ink channel 25 will shear off air bubbles extending into the main ink channel, which can then be flushed out of the outlet 29. In this way, the amount of air in the air cavities 26 is self-regulating—the air cavities are replenished with air via air bubbles rising from the lower manifold 14 (e.g. via nozzle 'gulping') and the design of the ribs 32 with protruding lips 33 encourages any excess air to become entrained in the flow ink towards the outlet 29.

Referring now to FIGS. 10 to 16, in a first embodiment a base 41 of the lower ink manifold 14 comprises a floor 42 of the main ink channel 25, with the floor 42 defining a plurality of ink supply slots 44. The ink supply slots 44 receive ink from the main ink channel 25 and supply the ink into the backsides of the printhead chips 16 via the die-attach film 18. The ink supply slots 44 are longitudinally spaced apart along a length of the floor 42 and separated from each other by support webs, which take the form of diagonal joint webs 46 and transverse webs 48. The printhead chips 16 are attached to the base 41 of the lower ink manifold 14 via the adhesive die-attach film 18. The die-attach film 18 has a plurality of slot openings 50 mirroring the ink supply slots 44; and a plurality of film webs 52 mirroring the diagonal joint webs 46 and transverse webs 48 of the lower ink manifold 14.

The arrangement of the main ink channel 25 and ink supply slots 44 is designed to maximize a volume of ink available to each printhead chip 16, whilst providing sufficient support for attaching the printhead chips to the base 41. The end portions of each printhead chip 16 are supported by the diagonal joint webs 46 and a minimum number of transverse webs 48 are positioned between the diagonal joint webs for supporting the middle part of each printhead chip. Each butting pair of printhead chips 16 have respective longitudinal end portions supported on a common diagonal joint web 46.

The ink supply slots 44 have a width, which is at least half the width of the printhead chips 16. Further, a combined area of ink supply slots 44 supplying ink to one printhead chip 16 is at least half a total area of the printhead chip. This arrangement maximizes ink flow to the printhead chips 16 as well as providing an open architecture which allows air bubbles to vent from the printhead chips into the ink manifold assembly 10.

Figure 16:
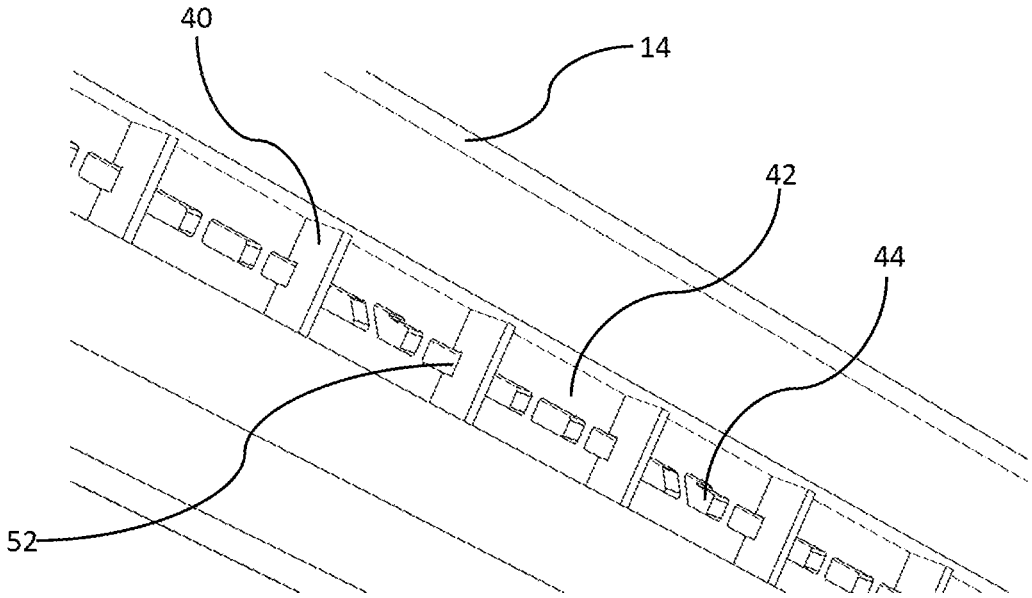
FIG. 16 is a perspective of an alternative rib structure for the lower ink manifold.
Figure 17:
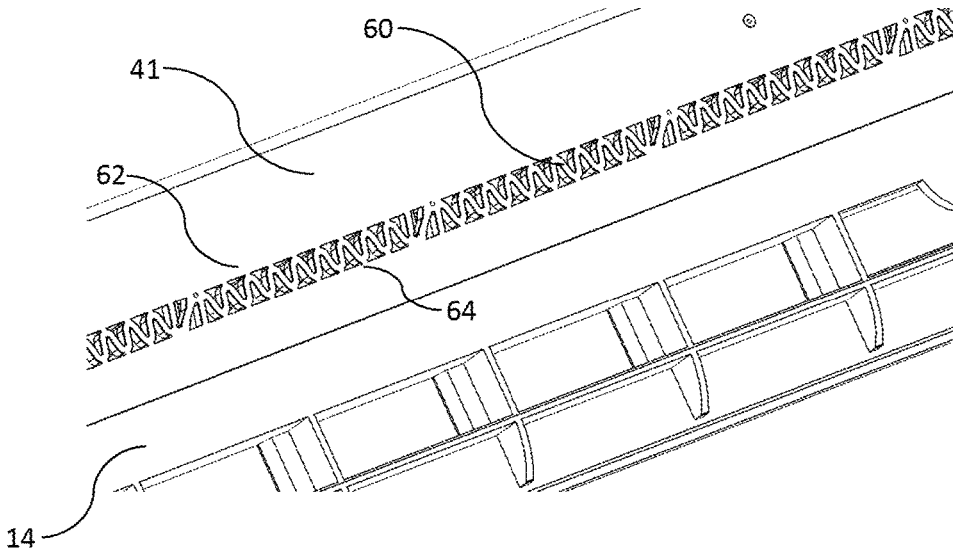
FIG. 17 is a bottom perspective an alternative lower ink manifold having a truss structure.

Trapped air bubbles are a perennial problem in the design of inkjet printheads. FIG. 16 shows a variant of the lower ink manifold 14 whereby each second rib 40 has a lower recess 52 opposite the ink supply slots 44. The recess 52 is positioned to provide a venting pathway from the printhead chips 16, as well as allowing ink flow through the main ink channel 25 both above and below the second ribs 40. In this way, trapped air bubbles may be more readily flushed from the main ink channel 25.

Referring to FIGS. 17 to 22, in a second embodiment of the lower ink manifold 14, the base 41 has a truss structure 60 supporting the printhead chips 16. The truss structure 60 has a first chord 62 and an opposite second chord 64, with a plurality of truss webs 66 extending between the two chords to define laterally flared ink outlets 61. The truss webs 66 are contiguously defined by a generally wavelike structure, which extends between the first and second chords 62 and 64 along the length of each printhead chip. Other truss configurations (e.g. regular diagonal webs) are, of course, within the ambit of the present invention.

The truss structure 60 provides excellent mechanical support for mounting the printhead chips 16. The truss webs 66 allow printhead chips 16 to be mounted to the base 41 of the lower ink manifold 14 with minimal chip cracking. Furthermore, the laterally flared ink outlets 61 are optimized for bubble venting as well as ink flow into the printhead chips.

Figure 18:
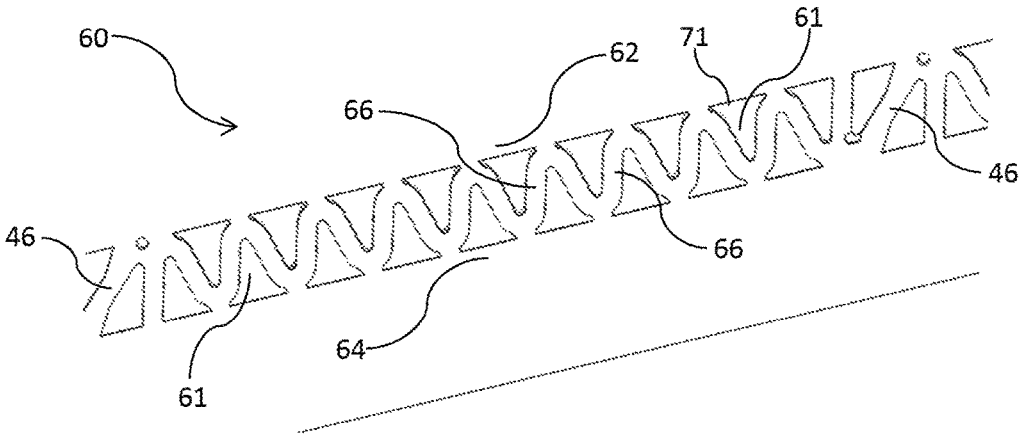
FIG. 18 is a magnified view of part of the truss structure.

As best shown in FIG. 18, the ink outlets 61 are defined by openings between the truss webs 66 and the chords 62 and 64, and are generally triangular or bell-shaped. Hence, the ink outlets 61 are alternately flared towards opposite longitudinal edges of the printhead chips 16 when the printhead chips are mounted to the truss structure 60. This flared arrangement encourages air bubbles to move towards (and beyond) the longitudinal edges of the printhead chips, and ultimately outside a footprint of the printhead chips. The design of the second embodiment, therefore, addresses a potential problem in the regular slot design (see FIGS. 10 and 11) of the first embodiment. With rectangular ink supply slots 44, buoyant air bubbles may become trapped within the slots by virtue of their inability to overcome the downward force of ink flow entering the printhead chips 16. However, if air bubbles are encouraged to move laterally towards and beyond the edges of the printhead chips 16, by virtue of laterally flared ink outlets 61, the incoming ink flow into the printhead chips cannot be blocked by air bubbles having insufficient buoyancy to escape from the ink outlets. Instead, air bubbles lacking sufficient buoyancy are moved into a lateral bubble-venting cavity 70, which is offset from the printhead chips, until such time that those air bubbles achieve sufficient buoyancy to escape upwards through the ink manifold assembly 10. The lateral flaring of the ink outlets 61 encourages movement of air bubbles in the desired manner away from the printhead chips 16.

Figure 19:
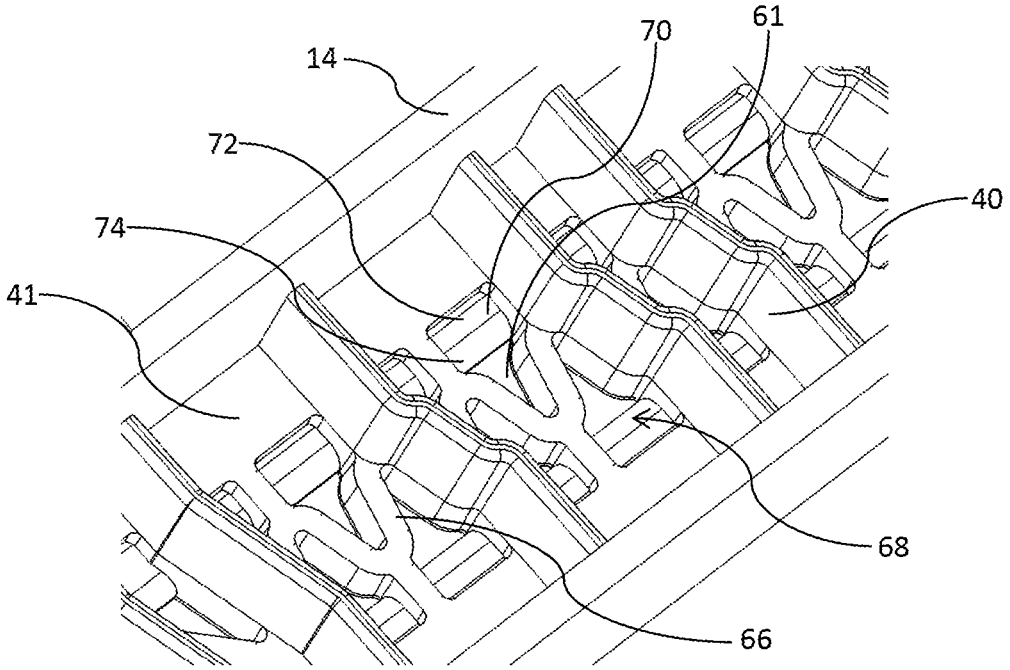
FIG. 19 is a top perspective of the truss structure.
Figure 20:
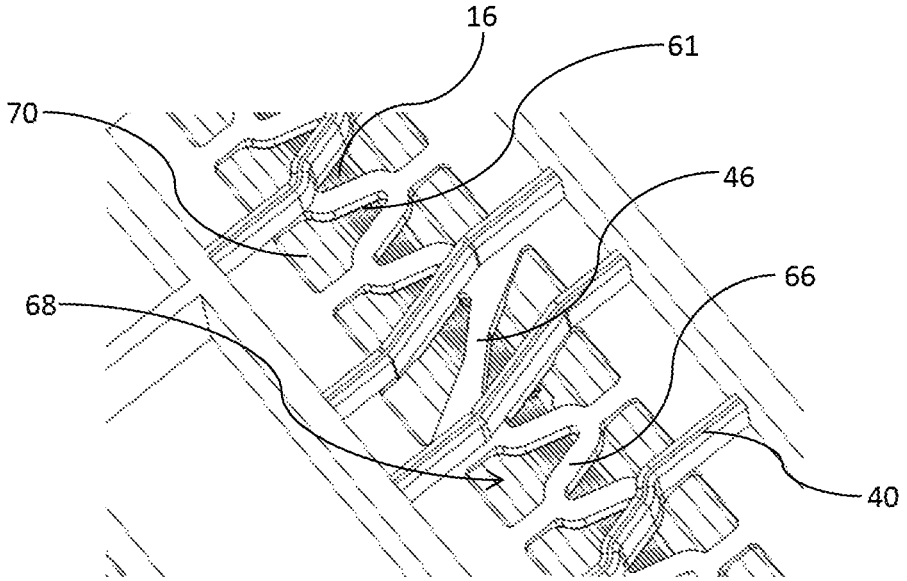
FIG. 20 is a top perspective of the truss structure with printhead chips attached.
Figure 21:
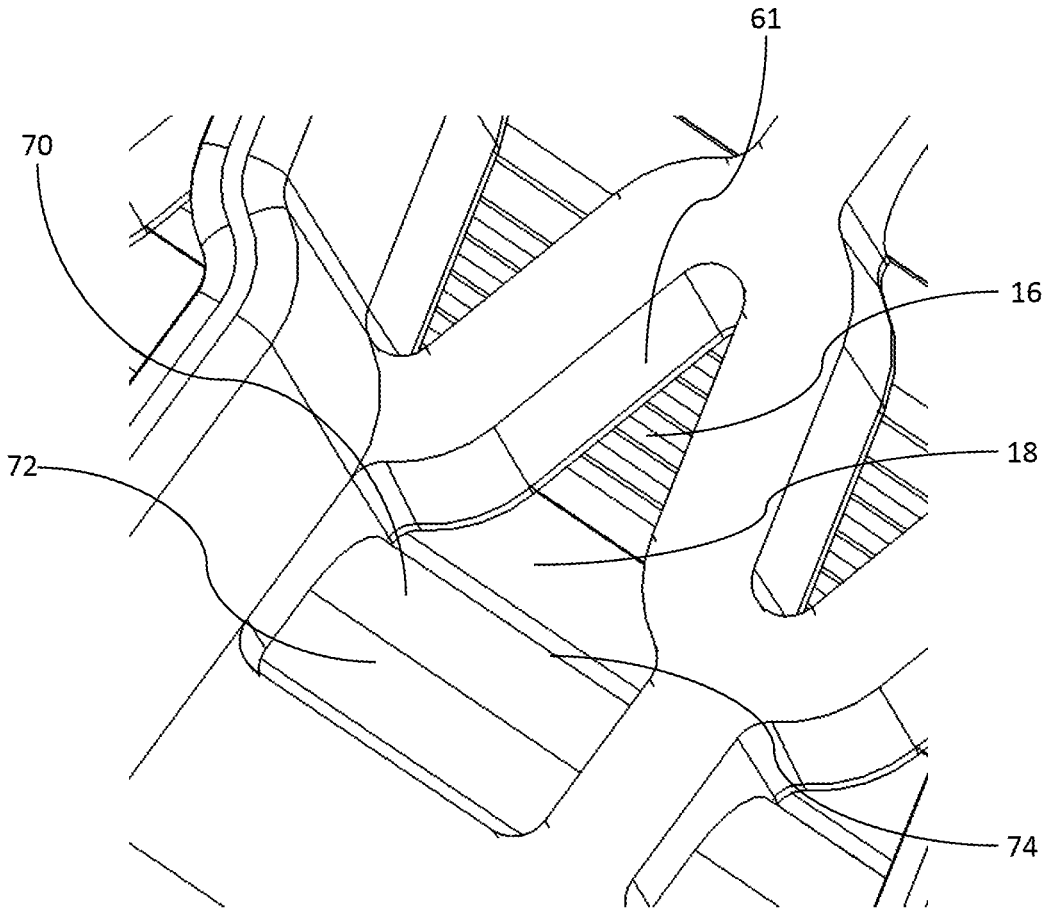
FIG. 21 is a magnified view of an individual ink delivery compartment.

Referring now to FIGS. 19 to 21, a plurality of ink delivery compartments 68 are defined in the base 41 of the lower ink manifold 14 according to the second embodiment. Each ink delivery compartment 68 comprises a respective laterally flared ink outlet 61 aligned with a printhead chip 16 and a respective bubble-venting cavity 70 offset from the printhead chip. The bubble-venting cavity 70 meets with a flared (wider) end 71 of the ink outlet 61 and is configured for receiving air bubbles therefrom. The ink delivery compartment 68 comprises a shelf 72 which defines a floor for the bubble-venting cavity 70. The shelf 72 has a lateral edge 74 curved downwards towards the printhead chip 16 and towards the flared ink outlet 61. Hence, any air bubble(s) in the ink outlet 61 are encouraged to move laterally and upwards from the ink outlet into the bubble-venting cavity 70.

Figure 22:
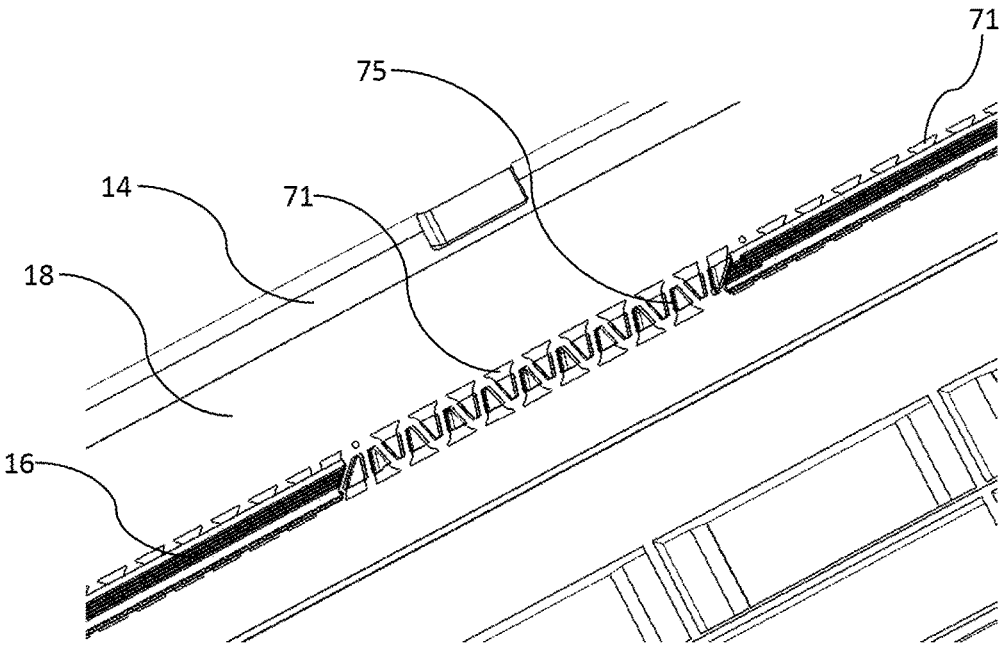
FIG. 22 is a bottom perspective of the truss structure with a transparent die-attach film and one printhead chip removed.
Figure 23:
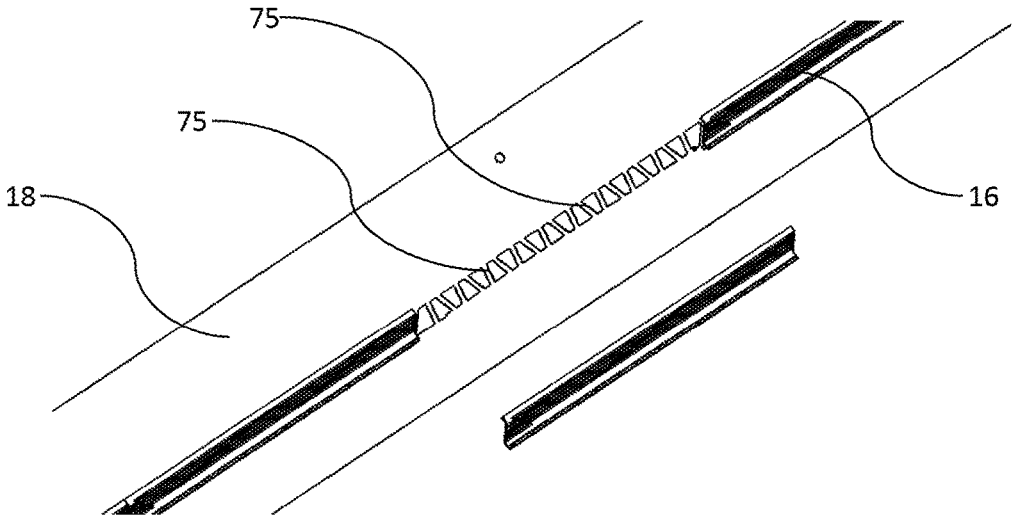
FIG. 23 is the die-attach film shown in FIG. 21 with one printhead chip removed.

As shown in FIG. 23, the die-attach film 18 of the second embodiment has a row of alternately inverted trapezoidal openings 75 through which ink is received by the printhead chips 16 from the ink outlets 61 of the lower ink manifold 14. Referring to FIG. 22, the die-attach film 18 is shown in transparent overlay on the base of the lower ink manifold 14 to reveal the positional relationship between the ink outlets 61, the printhead chips 16 and the trapezoidal openings 75 defined in the die-attach film. Each trapezoidal opening 75 is aligned with a respective ink outlet 61 with the flared end 71 of each ink outlet extending beyond a wider end of the trapezoidal opening. With the printhead chips 16 mounted on the base of the lower ink manifold 14 via the die attach film 18, the flared ends 71 of the ink outlets 61 also protrude beyond a longitudinal edge of the printhead chips. Accordingly, the die-attach film 18 and the truss structure 60 cooperate to provide sealed attachment of the printhead chips 16 to the base of the lower ink manifold 14, whilst enabling any air bubbles rising from the printhead chips to move outside a footprint of the printhead chips.

Figure 24:
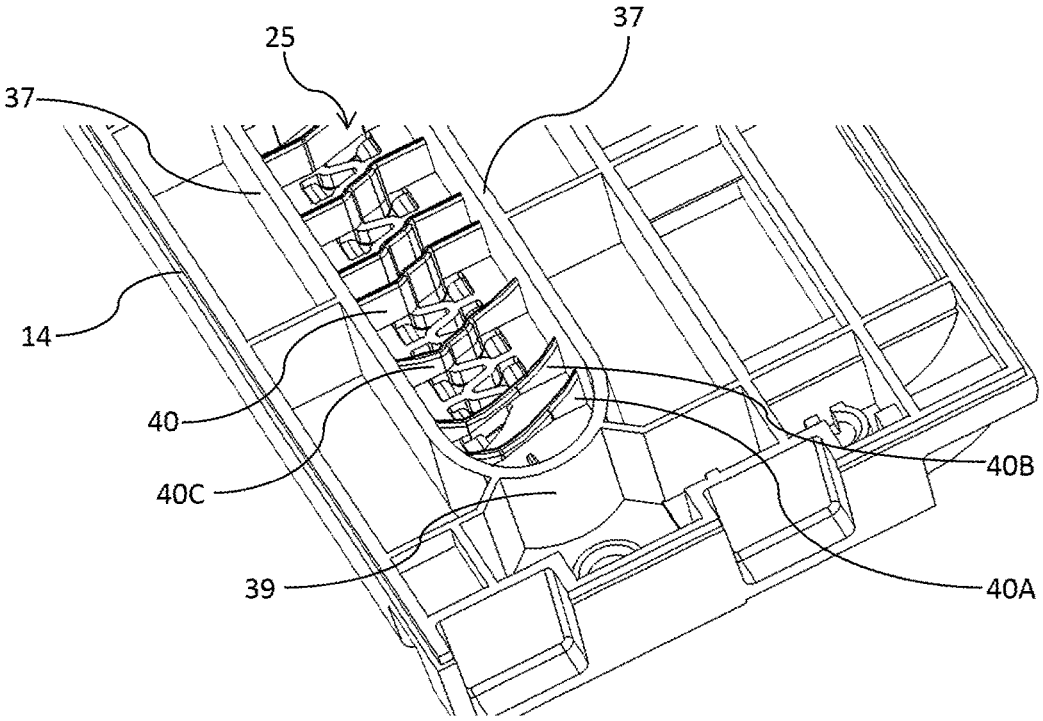
FIG. 24 is a magnified view of one end of the alternative lower ink manifold.

Referring to FIG. 24, in the second embodiment of the lower ink manifold 14, the second ribs 40, which extend transversely between the longitudinal sidewalls 37, have different profiles towards the ends of the main ink channel 25. In particular, the heights of the second ribs 40 decreases towards each of curved endwalls 39. As shown in FIG. 24, the second rib 40A, which is nearest to endwall 39 and the outlet boss 29A of the upper ink manifold 12, has an inverted arch profile and a lowest height. The second rib 40B, which is second closest to the endwall 39 has an inverted arch profile and is relatively higher than the second rib 40A. And the second rib 40C, which is third closest to the endwall 39, is relatively higher still than the second rib 40B. The remaining second ribs 40 have a uniform height, which is still less than a height of the longitudinal sidewalls 37.

By reducing the heights of the second ribs 40 towards each end of the main ink channel 25, the flow resistance of the ink is reduced as the ink changes direction from the inlet 27 into the main ink channel, and, likewise, as the ink changes direction from the main ink channel into the outlet 29. This assists in maintaining a relatively constant flow resistance across an entire length of the printhead 1 and minimizes any print artefacts that may otherwise result from a relatively increased flow resistance at the end regions where the ink changes direction.

It will, of course, be appreciated that the present invention has been described by way of example only and that modifications of detail may be made within the scope of the invention, which is defined in the accompanying claims.

The invention claimed is:

1. An inkjet printhead comprising:

an elongate fluid manifold having a plurality of fluid outlets positioned longitudinally along a base of the fluid manifold, wherein neighboring pairs of fluid outlets are separated by support webs; and a plurality of butting printhead chips arranged in a row and attached to the base of the fluid manifold, each printhead chip receiving a printing fluid from one or more fluid outlets, wherein each butting pair of printhead chips have respective butting end portions commonly supported by one of the support webs, said support web having a profile corresponding to the ends of the printhead chips.

2. The inkjet printhead of claim 1, wherein a total combined area of the fluid outlets is greater than a total combined area of the support webs.

3. The inkjet printhead of claim 1, wherein each support web occludes less than 10% of an area of ink supply channels defined in a backside of each printhead chip.

4. The inkjet printhead of claim 1, wherein each of the support webs supporting the butting end portions extends diagonally between ink supply slots.

5. The inkjet printhead of claim 1, wherein each printhead chip has a mid-portion between opposite end portions, the mid-portion being supported by one or more further support webs.

6. The inkjet printhead of claim 5, wherein a number of further support webs supporting the mid-portion of each printhead chip is from 1 to 10.

7. The inkjet printhead of claim 1, wherein each fluid outlet has a width of at least half a width of each printhead chip.

8. The inkjet printhead of claim 1, wherein a combined area of fluid outlets supplying ink to one printhead chip is at least half a total area of the printhead chip.

9. The inkjet printhead of claim 1, wherein the printhead chips are attached to the base of the fluid manifold via an adhesive film, the adhesive film having openings aligned with the fluid outlets.

* * * * *